US007809490B2

(12) United States Patent
Liu et al.

(10) Patent No.: US 7,809,490 B2
(45) Date of Patent: Oct. 5, 2010

(54) PHASE AND FREQUENCY ERROR BASED ASYMMETRICAL AFR PULSE REFERENCE TRACKING ALGORITHM USING THE PRE-CATALYST O2 SENSOR SWITCHING OUTPUT

(75) Inventors: Sharon Liu, Ann Arbor, MI (US); Kenneth P. Dudek, Rochester Hills, MI (US); Robert Douglas Shafto, New Hudson, MI (US)

(73) Assignee: GM Global Technology Operations, Inc.

( * ) Notice: Subject to any disclaimer, the term of this patent is extended or adjusted under 35 U.S.C. 154(b) by 221 days.

(21) Appl. No.: 12/131,557

(22) Filed: Jun. 2, 2008

(65) Prior Publication Data

US 2009/0048759 A1 Feb. 19, 2009

Related U.S. Application Data

(60) Provisional application No. 60/956,590, filed on Aug. 17, 2007.

(51) Int. Cl.
*F02D 41/00* (2006.01)

(52) U.S. Cl. ..... 701/103; 123/672

(58) Field of Classification Search ..... 701/103–105, 701/114; 123/694, 675, 672; 60/275, 276
See application file for complete search history.

(56) References Cited

U.S. PATENT DOCUMENTS

| | | | | |
|---|---|---|---|---|
| 4,386,592 | A * | 6/1983 | Ohgami et al. | 123/694 |
| 4,402,292 | A * | 9/1983 | Ohgami et al. | 123/694 |
| 4,402,293 | A * | 9/1983 | Ohgami | 123/675 |
| 5,385,134 | A * | 1/1995 | Krohm et al. | 123/676 |
| 5,996,337 | A * | 12/1999 | Blosser et al. | 60/274 |
| 6,892,528 | B2 * | 5/2005 | Okada et al. | 60/277 |

* cited by examiner

*Primary Examiner*—Stephen K Cronin
*Assistant Examiner*—Johnny H Hoang

(57) ABSTRACT

A fuel control system of an engine system comprising a pre-catalyst exhaust gas oxygen (EGO) sensor and a control module. The pre-catalyst EGO sensor determines a pre-catalyst EGO signal based on an oxygen concentration of an exhaust gas. The control module determines a dither signal. The control module determines a fuel command based on the pre-catalyst EGO signal and the dither signal.

19 Claims, 6 Drawing Sheets

PHASE AND FREQUENCY ERROR BASED ASYMMETRICAL AFR PULSE REFERENCE TRACKING ALGORITHM USING THE PRE-CATALYST O2 SENSOR SWITCHING OUTPUT

CROSS-REFERENCE TO RELATED APPLICATIONS

This application claims the benefit of U.S. Provisional Application No. 60/956,590, filed on Aug. 17, 2007. The disclosure of the above application is incorporated herein by reference in its entirety.

FIELD

The present disclosure relates to engine control systems, and more particularly to fuel control systems for internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system reduces emissions of a gasoline engine. The fuel control system may include an inner feedback loop and an outer feedback loop. The inner feedback loop may use data from an exhaust gas oxygen (EGO) sensor arranged before a catalytic converter of the engine system (i.e., a pre-catalyst EGO sensor) to control an amount of fuel sent to the engine.

For example, when the pre-catalyst EGO sensor senses a rich air/fuel ratio in an exhaust gas (i.e., non-burnt fuel vapor), the inner feedback loop may decrease a desired amount of fuel sent to the engine (i.e., decrease a fuel command). When the pre-catalyst EGO sensor senses a lean air/fuel ratio in the exhaust gas (i.e., excess oxygen), the inner feedback loop may increase the fuel command. This maintains the air/fuel ratio at true stoichiometry, or an ideal air/fuel ratio, improving the performance (e.g., the fuel economy) of the fuel control system.

The inner feedback loop may use a proportional-integral control scheme to correct the fuel command. The fuel command may be further corrected based on a short term fuel trim or a long term fuel trim. The short term fuel trim may correct the fuel command by changing gains of the proportional-integral control scheme based on engine operating conditions. The long term fuel trim may correct the fuel command when the short term fuel trim is unable to fully correct the fuel command within a desired time period.

The outer feedback loop may use information from an EGO sensor arranged after the converter (i.e., a post-catalyst EGO sensor) to correct the EGO sensors and/or the converter when there is an unexpected reading. For example, the outer feedback loop may use the information from the post-catalyst EGO sensor to maintain the post-catalyst EGO sensor at a required voltage level. As such, the converter maintains a desired amount of oxygen stored, improving the performance of the fuel control system. The outer feedback loop may control the inner feedback loop by changing thresholds used by the inner feedback loop to determine whether the air/fuel ratio is rich or lean.

Exhaust gas composition affects the behavior of the EGO sensors, thereby affecting accuracy of the EGO sensor values. As a result, fuel control systems have been designed to operate based on values that are different than those reported. For example, fuel control systems have been designed to operate "asymmetrically," (i.e., the threshold used to indicate the lean air/fuel ratio is different than the threshold used to indicate the rich air/fuel ratio).

Since the asymmetry is a function of the exhaust gas composition and the exhaust gas composition is a function of the engine operating conditions, the asymmetry is typically designed as a function of the engine operating conditions. The asymmetry is achieved indirectly by adjusting the gains and the thresholds of the inner feedback loop, requiring numerous tests at each of the engine operating conditions. Moreover, this extensive calibration is required for each powertrain and vehicle class and does not easily accommodate other technologies, including, but not limited to, variable valve timing and lift.

SUMMARY

A fuel control system of an engine system comprising a pre-catalyst exhaust gas oxygen (EGO) sensor and a control module. The pre-catalyst EGO sensor determines a pre-catalyst EGO signal based on an oxygen concentration of an exhaust gas. The control module determines a dither signal. The control module determines a fuel command based on the pre-catalyst EGO signal and the dither signal.

A method of operating a fuel control system of an engine system comprises determining a pre-catalyst EGO signal based on an oxygen concentration of an exhaust gas; determining a dither signal; and determining a fuel command based on the pre-catalyst EGO signal and the dither signal.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
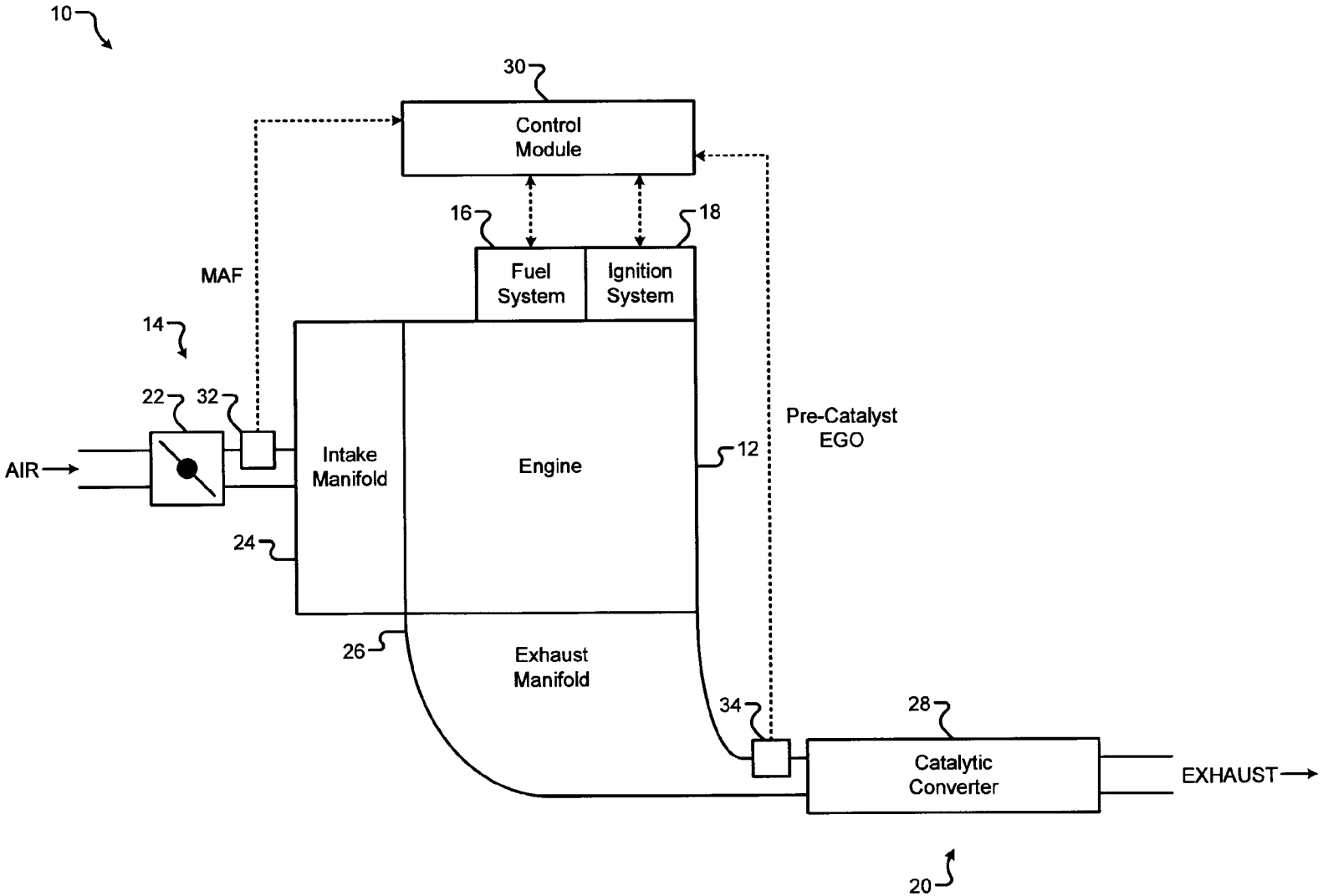
FIG. 1 is a functional block diagram of an exemplary implementation of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

To reduce calibration costs associated with conventional fuel control systems, the fuel control system of the present disclosure allows for direct achievement of desired behavior, including asymmetric behavior. In other words, the fuel control system achieves the desired behavior through open loop control instead of closed loop control. Open loop control may include using a model that relates the desired behavior to a fuel command or a dither signal needed to achieve the desired behavior instead of a calibration of closed loop control gains.

In particular, the fuel control system achieves the desired behavior of an oscillating oxygen concentration level of an exhaust gas of an engine system through open loop control. Such oscillations improve the performance of the fuel control system (i.e., prevent a low or a high oxygen storage level in a catalytic converter of the engine system). The fuel control system achieves the oscillating oxygen concentration level by determining a dither signal based on a model that relates the oscillating oxygen concentration level to the dither signal. The fuel control system applies the dither signal to the fuel command to cause the oscillations. In addition, the fuel control system tracks and corrects a frequency and a duty cycle (DC) of a signal based on the oscillating oxygen concentration level as described herein.

Referring now to FIG. 1, an exemplary engine system 10 is shown. The engine system 10 includes an engine 12, an intake system 14, a fuel system 16, an ignition system 18, and an exhaust system 20. The engine 12 may be any type of internal combustion engine with fuel injection. For example only, the engine 12 may include fuel injected engines, gasoline direct injection engines, homogeneous charge compression ignition engines, or other types of engines.

The intake system 14 includes a throttle 22 and an intake manifold 24. The throttle 22 controls air flow into the engine 12. The fuel system 16 controls fuel flow into the engine 12. The ignition system 18 ignites an air/fuel mixture provided to the engine 12 by the intake system 14 and the fuel system 16.

An exhaust gas created by combustion of the air/fuel mixture exits the engine 12 through the exhaust system 20. The exhaust system 20 includes an exhaust manifold 26 and a catalytic converter 28. The catalytic converter 28 receives the exhaust gas from the exhaust manifold 26 and reduces toxicity of the exhaust gas before it leaves the engine system 10.

The engine system 10 further includes a control module 30 that regulates operation of the engine 12 based on various engine operating parameters. The control module 30 is in communication with the fuel system 16 and the ignition system 18. The control module 30 is further in communication with a mass air flow (MAF) sensor 32 and an exhaust gas oxygen (EGO) sensor arranged in the exhaust manifold 26 (i.e., a pre-catalyst EGO sensor 34).

The MAF sensor 32 generates a MAF signal based on a mass of air flowing into the intake manifold 24. The pre-catalyst EGO sensor 34 generates a pre-catalyst EGO signal based on an oxygen concentration level of the exhaust gas in the exhaust manifold 26. The pre-catalyst EGO sensor 34 includes a switching EGO sensor that generates the pre-catalyst EGO signal in units of voltage. The switching EGO sensor switches the pre-catalyst EGO signal to a low or a high voltage when the oxygen concentration level is lean or rich, respectively.

Figure 2:
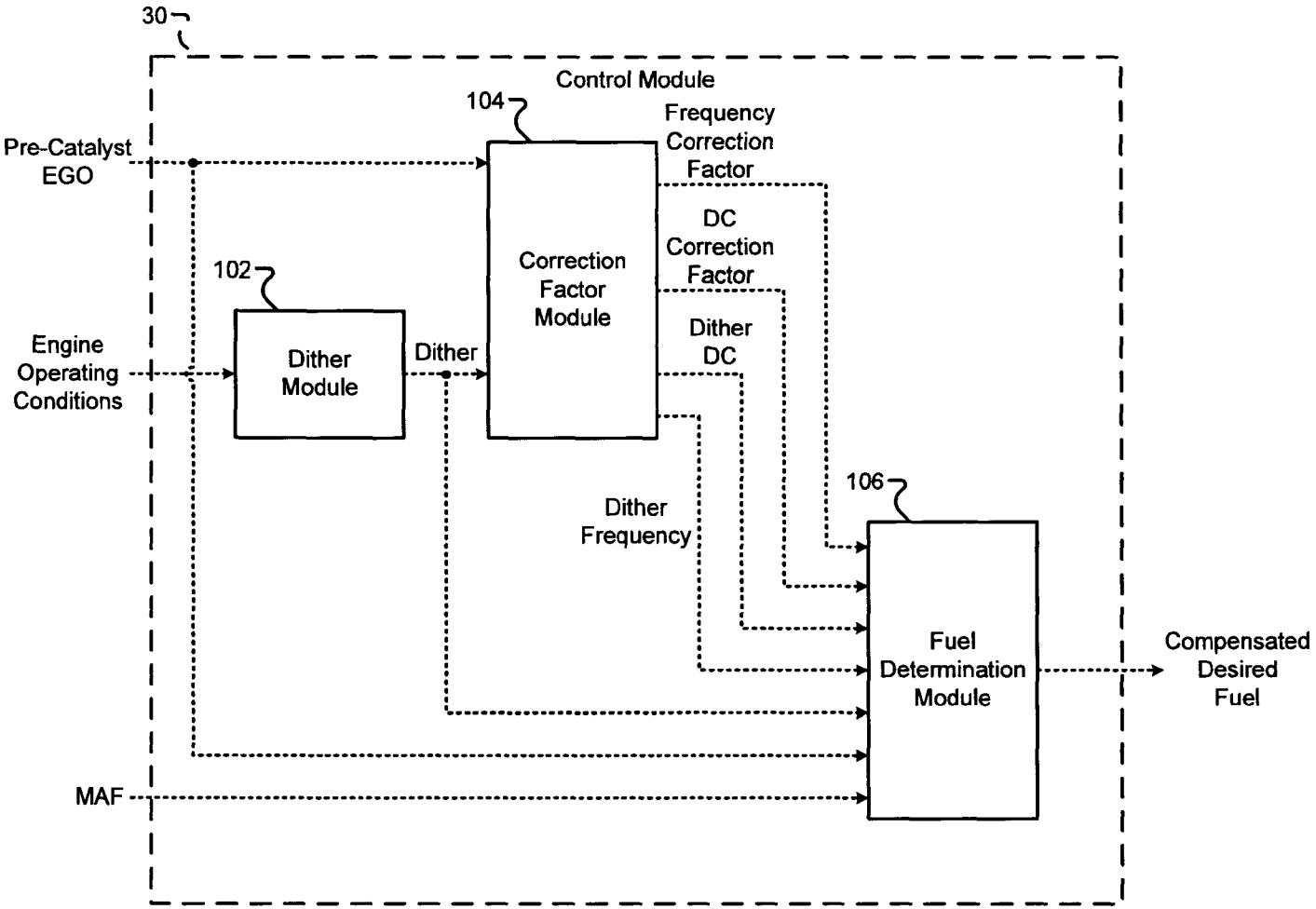
FIG. 2 is a functional block diagram of an exemplary implementation of a control module according to the principles of the present disclosure.

Referring now to FIG. 2, the control module 30 is shown. The control module 30 includes a dither module 102, a correction factor module 104, and a fuel determination module 106. The dither module 102 receives data on engine operating conditions.

For example only, the engine operating conditions may include, but are not limited to, a rotational velocity of a crankshaft (not shown) of the engine 12, an air pressure in the intake manifold 24, and/or a temperature of engine coolant. The dither module 102 is an open loop command generator that determines a dither signal based on the engine operating conditions. The control module 30 uses the dither signal to command oscillation of the oxygen concentration level of the exhaust gas in the exhaust manifold 26.

The correction factor module 104 receives the dither signal and the pre-catalyst EGO signal. The correction factor module 104 determines a frequency and a DC of the dither signal. The DC of the dither signal is a proportion of the period of the dither signal that the voltage of the dither signal is high (i.e., not zero in value).

The correction factor module 104 delays the frequency and the DC of the dither signal for a delay time period (i.e., until a fuel command of the control module 30 affects the pre-catalyst EGO signal). The correction factor module 104 determines the delay time period based on a number of cylinders of the engine 12 and a location of the pre-catalyst EGO sensor 34. The correction factor module 104 determines the delay time period further based on a measurement time period from when the control module 30 outputs the fuel command to the fuel system 16 to when the pre-catalyst EGO sensor 34 generates the pre-catalyst EGO signal. A delay time period period$_{delay}$ is determined according to the following relationship:

$$\text{period}_{delay}=f(\#,\text{location},\text{period}_{measure}), \tag{1}$$

where # is the number of cylinders, location is the location of the pre-catalyst EGO sensor 34, and period$_{measure}$ is the measurement time period.

The correction factor module 104 quantizes (i.e., converts into a discrete and/or digital signal) the pre-catalyst EGO signal and determines a frequency and a DC of the quantized pre-catalyst EGO signal. The correction factor module 104 compares the delayed frequency of the dither signal to the frequency of the quantized pre-catalyst EGO signal to determine a frequency correction factor. The correction factor module 104 compares the delayed DC of the dither signal to the DC of the quantized pre-catalyst EGO signal to determine a DC correction factor.

The correction factor module 104 uses a proportional (P) control scheme to meet the delayed frequency and the delayed DC of the dither signal. The frequency correction factor includes a proportional offset based on the difference between the delayed frequency of the dither signal and the frequency of the quantized pre-catalyst EGO signal. A frequency correction factor $P_f$ is determined according to the following equation:

$$P_f=Kp_f(f_{dither}(k-n)-f_{measured}(k-n)), \tag{2}$$

where $Kp_f$ is a predetermined proportional constant, $f_{dither}(k-n)$ is the delayed frequency of the dither signal, $f_{measured}(k-n)$ is the frequency of the quantized pre-catalyst EGO signal. The DC correction factor includes a proportional offset based on the difference between the delayed DC of the dither signal and the DC of the quantized pre-catalyst EGO signal. A DC correction factor $P_{DC}$ is determined according to the following equation:

$$P_{DC}=Kp_{DC}(DC_{dither}(k-n)-DC_{measured}(k-n)), \quad (3)$$

where $Kp_{DC}$ is a predetermined proportional constant, $DC_{dither}(k-n)$ is the delayed DC of the dither signal, $DC_{measured}(k-n)$ is the DC of the quantized pre-catalyst EGO signal.

The fuel determination module 106 receives the frequency correction factor, the DC correction factor, the DC of the dither signal, the frequency of the dither signal, the dither signal, and the pre-catalyst EGO signal. The fuel determination module 106 further receives the MAF signal. The fuel determination module 106 determines whether either of the correction factors is saturated. The frequency correction factor is saturated when it is so small in value that it corrects effectively no voltage switching in the dither signal. The DC correction factor is saturated when it is almost 1 or 0 in value that it corrects effectively no voltage switching in the dither signal.

If both of the correction factors are not saturated (i.e., in their linear range), the fuel determination module 106 compensates the frequency and the DC of the dither signal with the frequency correction factor and the DC correction factor, respectively. By compensating the frequency and the DC of the dither signal, the fuel determination module 106 corrects small errors between the delayed frequency and the delayed DC of the dither signal and the frequency and the DC of the quantized pre-catalyst EGO signal, respectively. The fuel determination module 106 determines a desired fuel command based on the compensated frequency of the dither signal, the compensated DC of the dither signal, the dither signal, and the MAF signal.

If either of the correction factors is saturated, the fuel determination module 106 discretely integrates the frequency correction factor. The fuel determination module 106 scales the integrated frequency correction factor with the sign of the quantized pre-catalyst EGO signal to determine the desired fuel correction factor. The fuel determination module 106 uses a proportional-integral control scheme to determine the desired fuel correction factor.

The desired fuel correction factor includes an offset based on a discrete integral of the difference between the delayed frequency of the dither signal and the frequency of the quantized pre-catalyst EGO signal. A desired fuel correction factor $Fuel_{PI}$ is determined according to the following equation:

$$Fuel_{PI}=\Sigma Ki_f \times P_f \times \text{sign}(EGO_{quant}), \quad (4)$$

where $Ki_f$ is a predetermined integral constant and $\text{sign}(EGO_{quant})$ is the quantized pre-catalyst EGO sign. The fuel determination module 106 compensates the desired fuel command with the desired fuel correction factor to determine a compensated desired fuel command for the fuel system 16. By compensating the desired fuel command, the fuel determination module 106 corrects large errors between the dither signal and the quantized pre-catalyst EGO signal.

Figure 3:
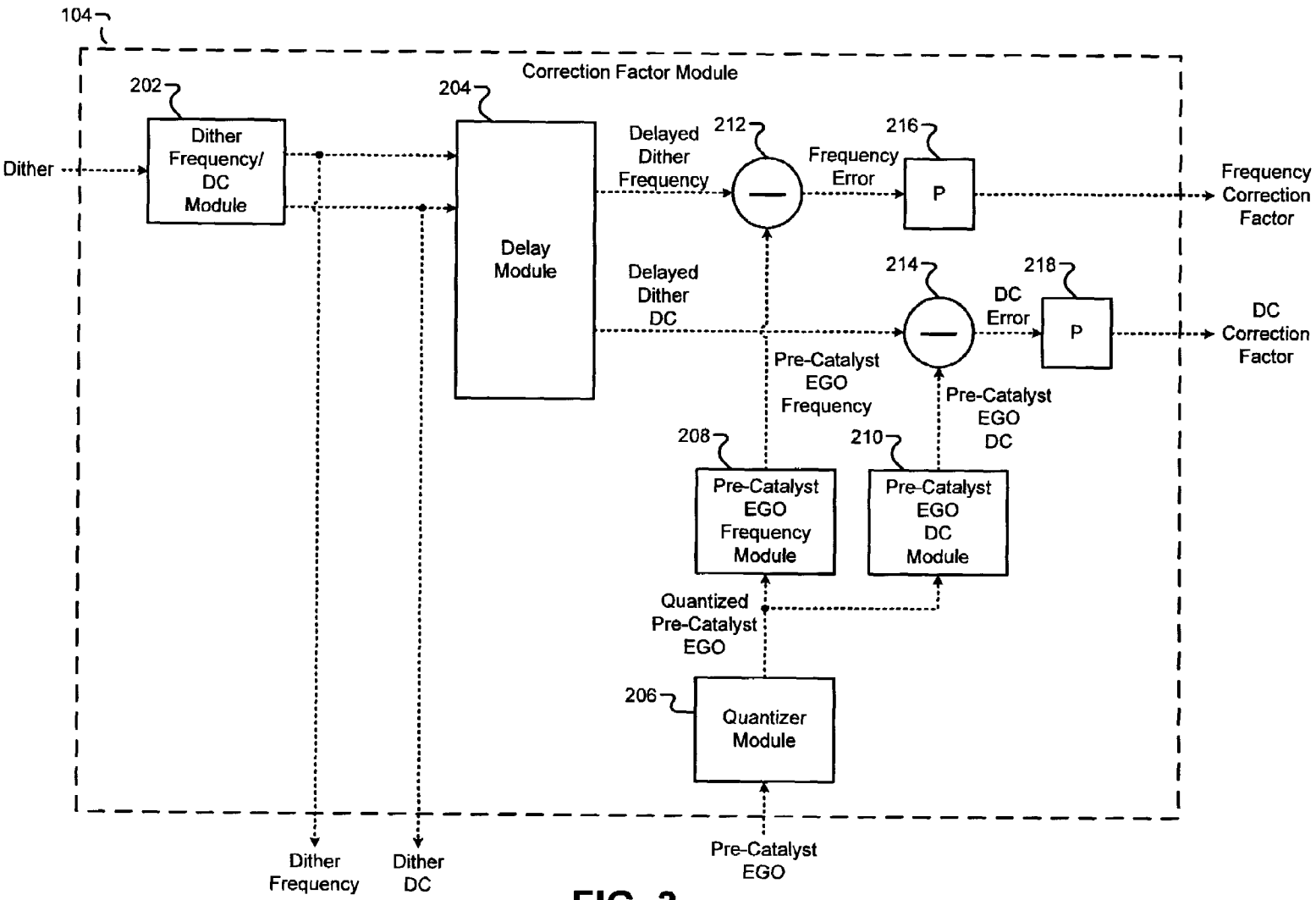
FIG. 3 is a functional block diagram of an exemplary implementation of a correction factor module according to the principles of the present disclosure.

Referring now to FIG. 3, the correction factor module 104 is shown. The correction factor module 104 includes a dither frequency/DC module 202, a delay module 204, a quantizer module 206, a pre-catalyst EGO frequency module 208, and a pre-catalyst EGO DC module 210. The correction factor module 104 further includes a subtraction module 212, a subtraction module 214, a P module 216, and a P module 218. The dither frequency/DC module 202 receives the dither signal and determines a frequency of the dither signal (i.e., a dither frequency). The dither frequency/DC module 202 further determines a DC of the dither signal (i.e., a dither DC).

The delay module 204 receives the dither frequency and the dither DC and determines the delay time period. The delay module 204 delays the dither frequency and the dither DC for the delay time period to determine a delayed dither frequency and a delayed dither DC. The quantizer module 206 receives the pre-catalyst EGO signal and quantizes the pre-catalyst EGO signal to determine a quantized pre-catalyst EGO signal. The pre-catalyst EGO frequency module 208 receives the quantized pre-catalyst EGO signal and determines the frequency of the quantized pre-catalyst EGO signal (i.e., a pre-catalyst EGO frequency). The pre-catalyst EGO DC module 210 receives the quantized pre-catalyst EGO signal and determines the DC of the quantized pre-catalyst EGO signal (i.e., a pre-catalyst EGO DC).

The subtraction module 212 receives the pre-catalyst EGO frequency and the delayed dither frequency and subtracts the pre-catalyst EGO frequency from the delayed dither frequency to determine a frequency error. The subtraction module 214 receives the pre-catalyst EGO DC and the delayed dither DC. The subtraction module 214 subtracts the pre-catalyst EGO DC from the delayed dither DC to determine a DC error. The P module 216 receives the frequency error and determines the frequency correction factor based on the frequency error. The P module 218 receives the DC error and determines the DC correction factor based on the DC error.

Figure 4:
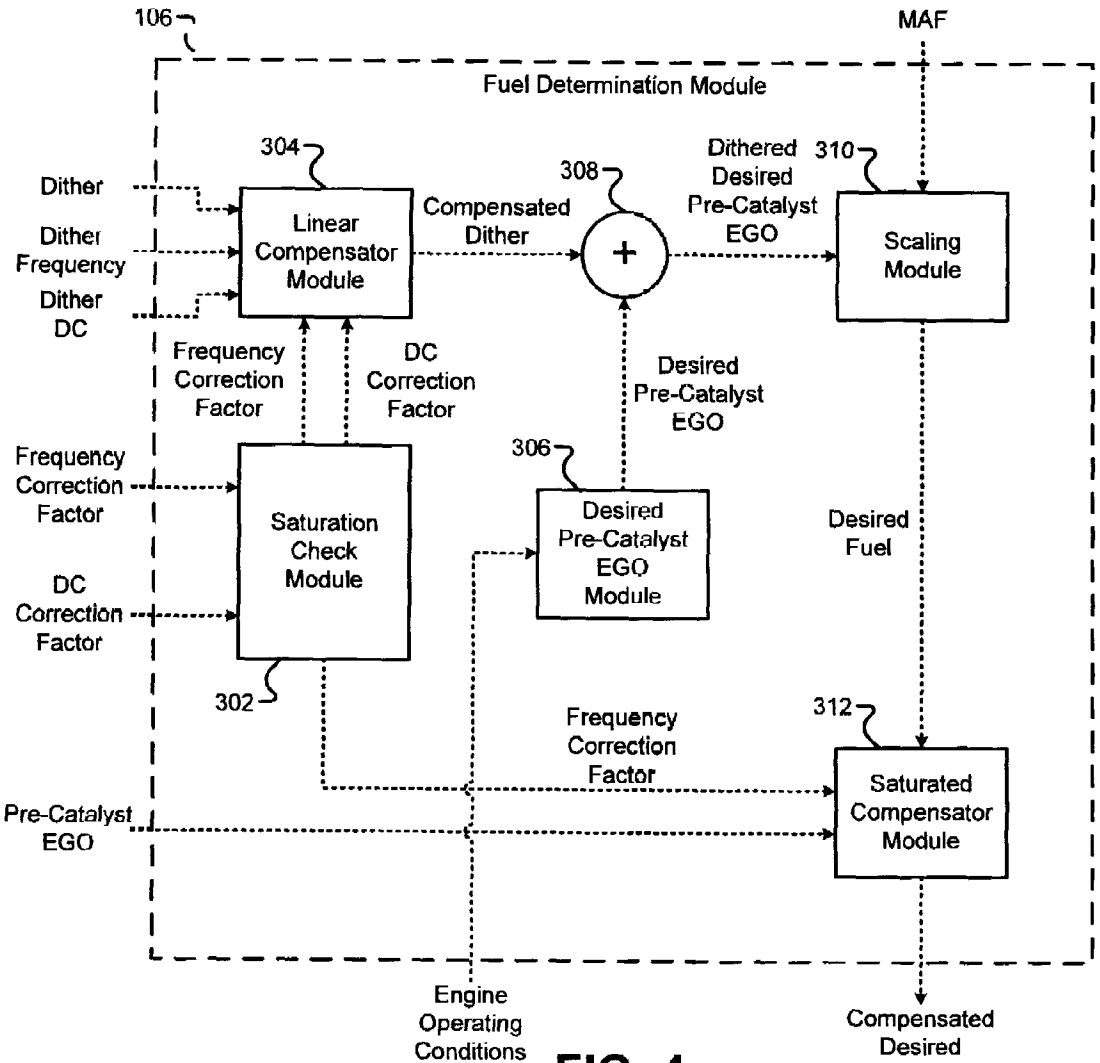
FIG. 4 is a functional block diagram of an exemplary implementation of a fuel determination module according to the principles of the present disclosure.

Referring now to FIG. 4, the fuel determination module 106 is shown. The fuel determination module 106 includes a saturation check module 302, a linear compensator module 304, a desired pre-catalyst EGO module 306, a summation module 308, a scaling module 310, and a saturated compensator module 312. The saturation check module 302 receives the frequency and the DC correction factors and determines whether either of the correction factors is saturated. When both of the correction factors are not saturated, the saturation check module 302 outputs the correction factors to the linear compensator module 304. When either of the correction factors is saturated, the saturation check module 302 outputs the frequency correction factor to the saturated compensator module 312.

The linear compensator module 304 receives the frequency correction factor, the DC correction factor, the dither signal, the dither frequency, and the dither DC. The linear compensator module 304 compensates the dither frequency and the dither DC with the frequency correction factor and the DC correction factor, respectively. The linear compensator module 304 determines a unity compensated dither signal (i.e., with an amplitude of 1 in value) based on the compensated dither frequency and the compensated dither DC. A unity compensated dither signal $Dither_{unity}$ is determined according to the following relationship:

$$Dither_{unity}=f(f_{dither}+P_f, DC_{dither}+P_{DC}). \quad (5)$$

The linear compensator module 304 further determines an amplitude of the dither signal. The linear compensator module 304 determines a compensated dither signal based on the unity compensated dither signal and the amplitude of the dither signal. By compensating the dither frequency and the dither DC, the linear compensator module 304 corrects small errors between the amplitudes of the dither signal and the quantized pre-catalyst EGO signal. This is because of the direct relationship between the dither frequency and the dither DC and a mean of the amplitude of the dither signal.

The desired pre-catalyst EGO module 306 receives the data on the engine operating conditions. The desired pre-catalyst EGO module 306 is an open loop command generator. The desired pre-catalyst EGO module 306 determines a desired pre-catalyst EGO signal based on a desired oxygen concentration level of the exhaust gas in the exhaust manifold 26. The desired pre-catalyst EGO module 306 determines the desired oxygen concentration level based on the engine operating conditions. The desired pre-catalyst EGO module 306 determines the desired pre-catalyst EGO signal in units of equivalence ratio.

The summation module 308 receives the desired pre-catalyst EGO signal and the compensated dither signal. The summation module 308 adds the compensated dither signal to the desired pre-catalyst EGO signal to determine a dithered desired pre-catalyst EGO signal. The dithered desired pre-catalyst EGO signal oscillates about the desired oxygen concentration level. The compensated dither signal causes the oscillations, while the desired pre-catalyst EGO signal causes the oscillating about the desired oxygen concentration level.

The scaling module 310 receives the dithered desired pre-catalyst EGO signal and the MAF signal. The scaling module 310 determines the desired fuel command based on the dithered desired pre-catalyst EGO signal and the MAF signal. A desired fuel command Fuel is determined according to the following equation:

$$\text{Fuel}=AFR_{stoich}\times MAF(EGO_{des}+A_{dither}\times \text{Dither}_{unity}), \quad (6)$$

where $AFR_{stoich}$ is a predetermined air-fuel ratio at stoichiometry (e.g., 1:14.7 for typical fuels), MAF is the MAF signal, $EGO_{des}$ is the desired pre-catalyst EGO signal, and $A_{dither}$ is the amplitude of the dither signal. The desired fuel command oscillates due to the oscillations of the dithered desired pre-catalyst EGO signal.

The saturated compensator module 312 receives the desired fuel command, the frequency correction factor, and the quantized pre-catalyst EGO signal. The saturated compensator module 312 integrates the frequency correction factor. The saturated compensator module 312 scales the integrated frequency correction factor with the sign of the quantized pre-catalyst EGO signal to determine the desired fuel correction factor. The saturated compensator module 312 compensates the desired fuel command with the desired fuel correction factor to determine the compensated desired fuel command for the fuel system 16. A compensated desired fuel command $\text{Fuel}_{comp}$ is determined according to the following equation:

$$\text{Fuel}_{comp}=\text{Fuel}+\text{Fuel}_{PI}. \quad (7)$$

Figure 5:
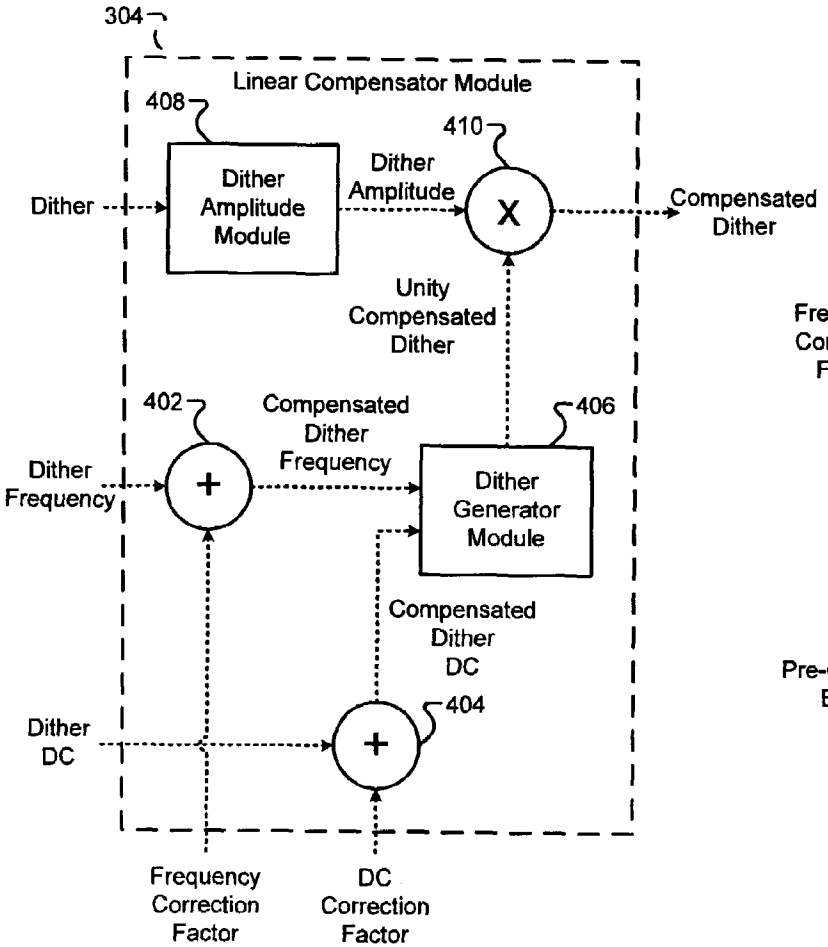
FIG. 5 is a functional block diagram of an exemplary implementation of a linear compensator module according to the principles of the present disclosure.

Referring now to FIG. 5, the linear compensator module 304 is shown. The linear compensator module 304 includes a summation module 402, a summation module 404, a dither generator module 406, a dither amplitude module 408, and a multiplication module 410. The summation module 402 receives the frequency correction factor and the dither frequency. The summation module 402 adds the frequency correction factor to the dither frequency to determine a compensated dither frequency.

The summation module 404 receives the DC correction factor and the dither DC and adds the DC correction factor to the dither DC to determine a compensated dither DC. The dither generator module 406 receives the compensated dither frequency and the compensated dither DC. The dither generator module 406 generates the unity compensated dither signal based on the compensated dither frequency and the compensated dither DC.

The dither amplitude module 408 receives the dither signal and determines the amplitude of the dither signal (i.e., a dither amplitude). The multiplication module 410 receives the dither amplitude and the unity compensated dither signal. The multiplication module 410 scales the unity compensated dither signal with the dither amplitude to determine the compensated dither signal.

Figure 6:
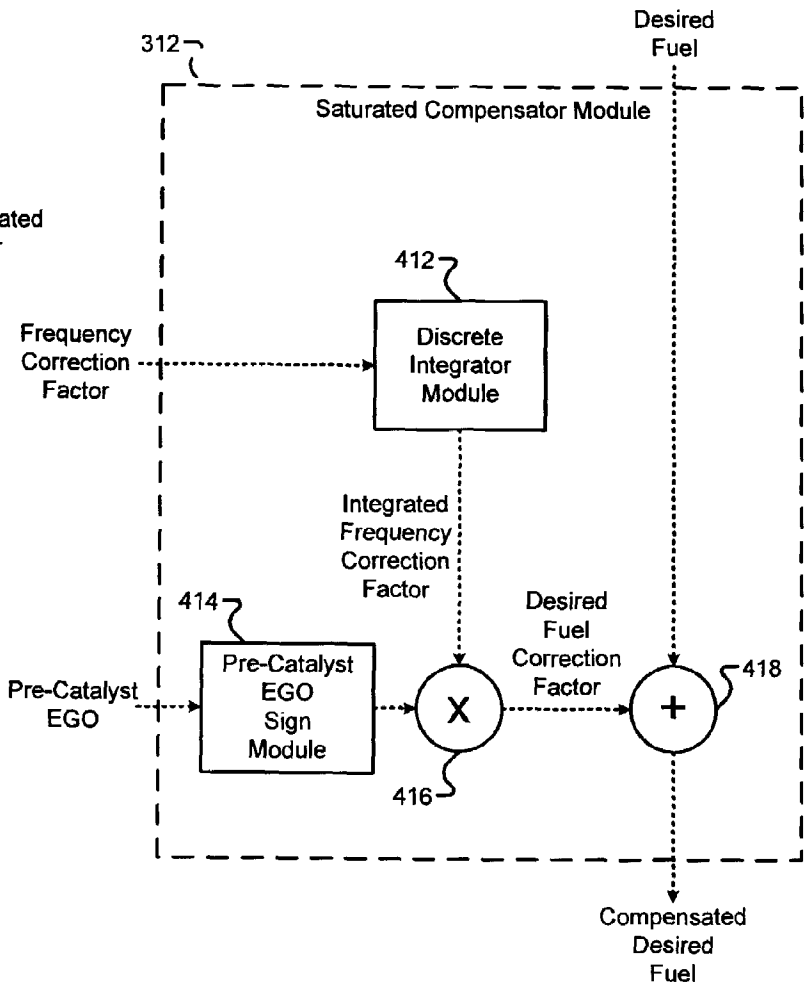
FIG. 6 is a functional block diagram of an exemplary implementation of a saturated compensator module according to the principles of the present disclosure.

Referring now to FIG. 6, the saturated compensator module 312 is shown. The saturated compensator module 312 includes a discrete integrator module 412, a pre-catalyst EGO sign module 414, a multiplication module 416, and a summation module 418. The discrete integrator module 412 receives the frequency correction factor. The discrete integrator module 412 discretely integrates the frequency correction factor to determine an integrated frequency correction factor. The pre-catalyst EGO sign module 414 receives the pre-catalyst EGO signal, quantizes the discrete pre-catalyst EGO signal, and determines a sign of the quantized pre-catalyst EGO signal.

The multiplication module 416 receives the integrated frequency correction factor and the sign of the quantized pre-catalyst EGO signal. The multiplication module 416 scales the integrated frequency correction factor with the sign of the quantized pre-catalyst EGO signal to determine the desired fuel correction factor. The summation module 418 receives the desired fuel correction factor and the desired fuel command. The summation module 418 adds the desired fuel correction factor to the desired fuel command to determine the compensated desired fuel command.

Figure 7:
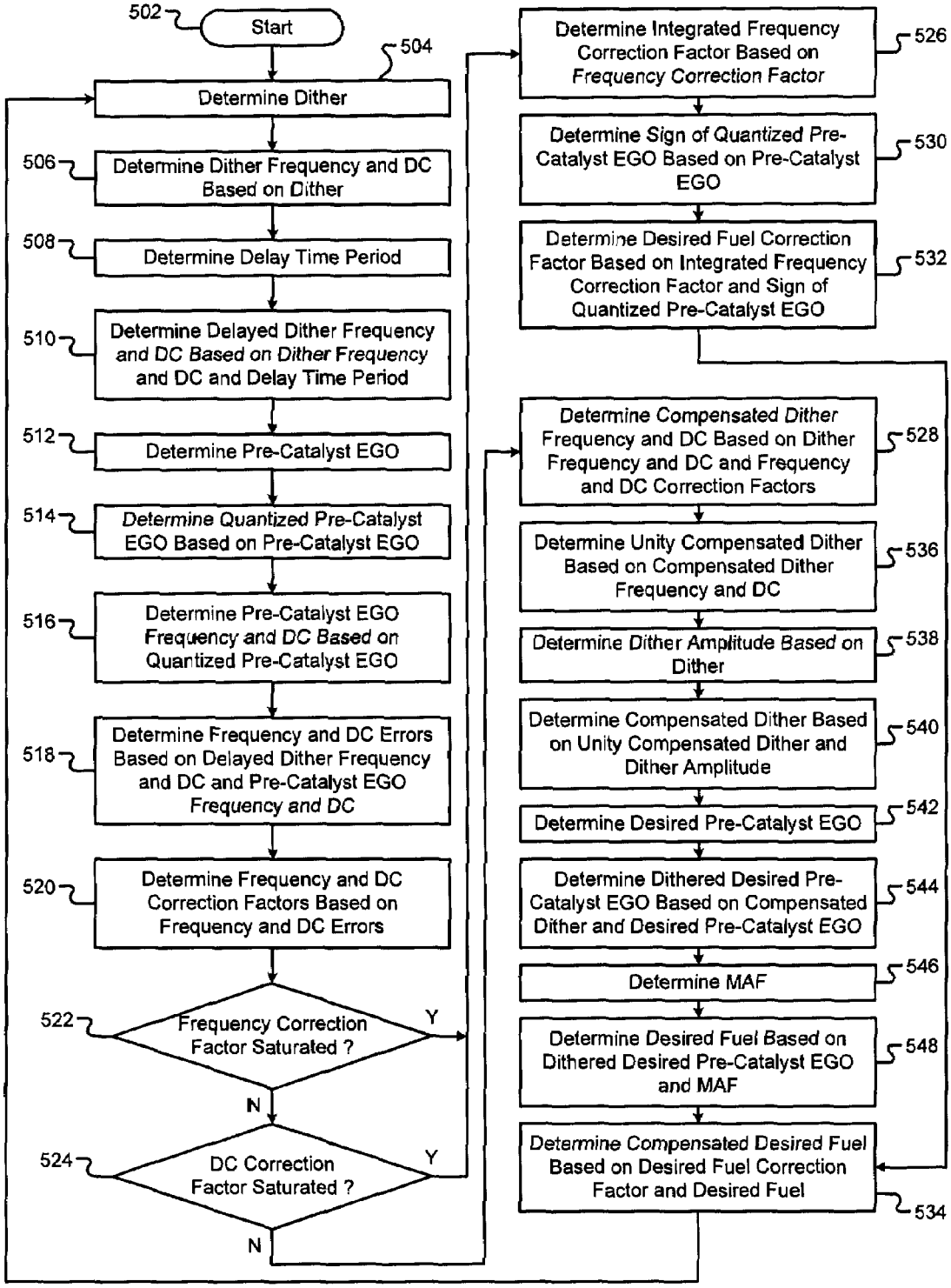
FIG. 7 is a flowchart depicting exemplary steps performed by the control module according to the principles of the present disclosure.

Referring now to FIG. 7, a flowchart depicts exemplary steps performed by the control module 30. Control starts in step 502. In step 504, the dither signal (i.e., Dither) is determined. In step 506, the dither frequency and the dither DC are determined based on the dither signal.

In step 508, the delay time period is determined. In step 510, the delayed dither frequency is determined based on the dither frequency and the delay time period, and the delayed dither DC is determined based on the dither DC and the delay time period. In step 512, the pre-catalyst EGO signal (i.e., Pre-Catalyst EGO) is determined.

In step 514, the quantized pre-catalyst EGO signal (i.e., Quantized Pre-Catalyst EGO) is determined based on the pre-catalyst EGO signal. In step 516, the pre-catalyst EGO frequency and the pre-catalyst EGO DC are determined based on the quantized pre-catalyst EGO signal. In step 518, the frequency error is determined based on the delayed dither frequency and the pre-catalyst EGO frequency, and the DC error is determined based on the delayed dither DC and the pre-catalyst EGO DC.

In step 520, the frequency and the DC correction factors are determined based on the frequency and DC errors, respectively. In step 522, control determines whether the frequency correction factor is saturated. If false, control continues in step 524. If true, control continues in step 526.

In step 524, control determines whether the DC correction factor is saturated. If true, control continues in step 526. If false, control continues in step 528. In step 526, the integrated frequency correction factor is determined based on the frequency correction factor.

In step 530, the sign of the quantized pre-catalyst EGO signal is determined based on the pre-catalyst EGO signal. In step 532, the desired fuel correction factor is determined based on the integrated frequency correction factor and the sign of the quantized pre-catalyst EGO signal. Control continues in step 534.

In step 528, the compensated dither frequency is determined based on the dither frequency and the frequency correction factor, and the compensated dither DC is determined based on the dither DC and the DC correction factor. In step 536, the unity compensated dither signal (i.e., Unity Compensated Dither) is determined based on the compensated dither frequency and the compensated dither DC. In step 538, the dither amplitude is determined based on the dither signal.

In step 540, the compensated dither (i.e., Compensated Dither) signal is determined based on the unity compensated dither signal and the dither amplitude. In step 542, the desired pre-catalyst EGO signal (i.e., Desired Pre-Catalyst EGO) is determined. In step 544, the dithered desired pre-catalyst EGO signal (i.e., Dithered Desired Pre-Catalyst EGO) is determined based on the compensated dither signal and the desired pre-catalyst EGO signal.

In step 546, the MAF signal (i.e., MAF) is determined. In step 548, the desired fuel command (i.e., Desired Fuel) is determined based on the dithered desired pre-catalyst EGO signal and the MAF signal. In step 534, the compensated desired fuel command (i.e., Compensated Desired Fuel) is determined based on the desired fuel correction factor and the desired fuel command. Control returns to step 504.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fuel control system of an engine system, comprising:

a pre-catalyst exhaust gas oxygen (EGO) sensor that determines a pre-catalyst EGO signal based on an oxygen concentration of an exhaust gas; and a control module that determines a dither signal, that determines a fuel command based on the pre-catalyst EGO signal and the dither signal, that determines a frequency of the pre-catalyst EGO signal, a duty cycle (DC) of the pre-catalyst EGO signal, a frequency of the dither signal, and a DC of the dither signal, that determines a frequency error based on the frequency of the pre-catalyst EGO signal and the frequency of the dither signal, that determines a DC error based on the DC of the pre-catalyst EGO signal and the DC of the dither signal, that determines a frequency correction factor based on the frequency error, that determines a DC correction factor based on the DC error, that determines a frequency of a compensated dither signal based on the frequency of the dither signal and the frequency correction factor, and that determines a DC of the compensated dither signal based on the DC of the dither signal and the DC correction factor when the frequency correction factor is greater than a predetermined value and the DC correction factor is within a predetermined range of values.

2. The fuel control system of claim 1 wherein the control module determines the dither signal based on one of a rotational velocity of a crankshaft, an air pressure in an intake manifold, and a temperature of engine coolant

3. The fuel control system of claim 1 wherein the control module determines an amplitude of the dither signal.

4. The fuel control system of claim 3 wherein the control module determines the compensated dither signal based on the amplitude of the dither signal, the frequency of the compensated dither signal, and the DC of the compensated dither signal.

5. The fuel control system of claim 4 wherein the control module determines the fuel command based on the compensated dither signal.

6. A fuel control system of an engine system, comprising:

a pre-catalyst exhaust gas oxygen (EGO) sensor that determines a pre-catalyst EGO signal based on an oxygen concentration of an exhaust gas; and a control module that determines a dither signal, that determines a fuel command based on the pre-catalyst EGO signal and the dither signal, that determines a frequency of the pre-catalyst EGO signal, a duty cycle (DC) of the pre-catalyst EGO signal, a frequency of the dither signal, and a DC of the dither signal, that determines a frequency error based on the frequency of the pre-catalyst EGO signal and the frequency of the dither signal, that determines a DC error based on the DC of the pre-catalyst EGO signal and the DC of the dither signal, that determines a frequency correction factor based on the frequency error, that determines a DC correction factor based on the DC error, that determines an integrated frequency correction factor based on the frequency correction factor when one of the frequency correction factor is less than a predetermined value and the DC correction factor is not within a predetermined range of values.

7. The fuel control system of claim 6 wherein the control module determines a sign of the pre-catalyst EGO signal.

8. The fuel control system of claim 7 wherein the control module determines a fuel correction factor based on the integrated frequency correction factor and the sign of the pre-catalyst EGO signal.

9. The fuel control system of claim 8 wherein the control module determines the fuel command based on the fuel correction factor.

10. The fuel control system of claim 6 wherein the control module determines the dither signal based on one of a rotational velocity of a crankshaft, an air pressure in an intake manifold, and a temperature of engine coolant.

11. A method of operating a fuel control system of an engine system, comprising:

determining a pre-catalyst EGO signal based on an oxygen concentration of an exhaust gas;

determining a dither signal;

determining a fuel command based on the pre-catalyst EGO signal and the dither signal;

determining a frequency of the pre-catalyst EGO signal, a duty cycle (DC) of the pre-catalyst EGO signal, a frequency of the dither signal, and a DC of the dither signal;

determining a frequency error based on the frequency of the pre-catalyst EGO signal and the frequency of the dither signal;

determining a DC error based on the DC of the pre-catalyst EGO signal and the DC of the dither signal;

determining a frequency correction factor based on the frequency error;

determining a DC correction factor based on the DC error;

determining a frequency of a compensated dither signal based on the frequency of the dither signal and the frequency correction factor; and determining a DC of the compensated dither signal based on the DC of the dither signal and the DC correction factor, when the frequency correction factor is greater than a predetermined value and the DC correction factor is within a predetermined range of values.

12. The method of claim 11 further comprising determining the dither signal based on one of a rotational velocity of a crankshaft, an air pressure in an intake manifold, and a temperature of engine coolant.

13. The method of claim 11 further comprising determining an amplitude of the dither signal.

14. The method of claim 13 further comprising determining the compensated dither signal based on the amplitude of the dither signal, the frequency of the compensated dither signal, and the DC of the compensated dither signal.

15. The method of claim 14 further comprising determining the fuel command based on the compensated dither signal.

16. The method of claim of claim 11 further comprising determining an integrated frequency correction factor based on the frequency correction factor when one of the frequency correction factor is less than a predetermined value and the DC correction factor is not within a predetermined range of values.

17. The method of claim 16 further comprising determining a sign of the pre-catalyst EGO signal.

18. The method of claim 17 further comprising determining a fuel correction factor based on the integrated frequency correction factor and the sign of the pre-catalyst EGO signal.

19. The method of claim 18 further comprising determining the fuel command based on the fuel correction factor.

* * * * *